US008128995B2

(12) United States Patent
Park et al.

(10) Patent No.: US 8,128,995 B2
(45) Date of Patent: Mar. 6, 2012

(54) METHOD OF FABRICATING LIQUID CRYSTAL DISPLAY PANEL FOR COATING LIQUID ON SUBSTRATE

(75) Inventors: Jeong Kweon Park, Kumi-shi (KR); O Jun Kwon, Kyoungsan-shi (KR)

(73) Assignee: LG Display Co., Ltd., Seoul (KR)

( * ) Notice: Subject to any disclaimer, the term of this patent is extended or adjusted under 35 U.S.C. 154(b) by 580 days.

(21) Appl. No.: 11/800,910

(22) Filed: May 8, 2007

(65) Prior Publication Data

US 2007/0212481 A1 Sep. 13, 2007

Related U.S. Application Data

(62) Division of application No. 10/958,059, filed on Oct. 4, 2004, now Pat. No. 7,279,044.

(30) Foreign Application Priority Data

Oct. 6, 2003 (KR) ..... 10-2003-69167

(51) Int. Cl.
*B05D 5/12* (2006.01)
*B05D 3/12* (2006.01)

(52) U.S. Cl. ..... 427/348; 427/64; 427/69

(58) Field of Classification Search ..... 427/64, 427/69, 348, 356
See application file for complete search history.

(56) References Cited

U.S. PATENT DOCUMENTS

| | | | | |
|---|---|---|---|---|
| 5,871,584 | A | 2/1999 | Tateyama et al. | |
| 6,692,165 | B2 | 2/2004 | Tanaka et al. | |
| 6,743,478 | B1 * | 6/2004 | Kiiha et al. | 427/294 |
| 2004/0202863 | A1 * | 10/2004 | Saito et al. | 428/411.1 |

FOREIGN PATENT DOCUMENTS

JP 09271705 10/1997

* cited by examiner

*Primary Examiner* — Brian K Talbot
(74) *Attorney, Agent, or Firm* — Brinks Hofer Gilson & Lione

(57) ABSTRACT

An apparatus for fabricating a liquid crystal display panel includes a slit nozzle for applying a photo-resist liquid on a substrate, a nozzle driver for driving the slit nozzle, an air intake for inhaling air and/or impurities on the substrate through the slit nozzle before photo-resist is deposited on the substrate, and a gas supplier for supplying a gas through one or more channels in the slit nozzle to the substrate after the photo-resist is deposited on the substrate.

6 Claims, 7 Drawing Sheets

METHOD OF FABRICATING LIQUID CRYSTAL DISPLAY PANEL FOR COATING LIQUID ON SUBSTRATE

This application is a divisional application of U.S. application Ser. No. 10/958,059, filed on Oct. 4, 2004 now U.S. Pat. No. 7,279,044, which claims the benefit of Korean Patent Application No.: P2003-69167, filed in Korea on Oct. 6, 2003, each of which is incorporated herein by reference.

BACKGROUND

1. Field

The present invention relates to an apparatus and a method of fabricating a liquid crystal display panel, and more particularly, to an apparatus and a method of fabricating a liquid crystal display panel for coating a photo-resist layer on a substrate.

2. Description of the Related Art

Recently, the importance of display devices has increased with an increase in the types of visual information transferring media available as well as the types and amount of information being transferred. Among the common devices, the cathode ray tube (CRT) is widely used. However, the CRT is heavy and large, neither of which is advantageous for use in portable electronic applications. Therefore, various types of flat display devices have been developed to overcome these defects.

The various types of flat display devices include a liquid crystal display (LCD) panel, a field emission display (FED), a plasma display panel (PDP) and an electro-luminescence (EL). These devices are available for sale in an assortment of forms.

Among these, the liquid crystal display panel can be used in electronic devices that are light, thin, and small. In addition, the mass productivity of liquid crystal display panel is continually being improved, so it has been rapidly replacing the CRT for many applications.

One type of liquid crystal display panel, using an active matrix, has excellent picture quality and low power consumption. The active-matrix liquid crystal display panel is speedily being developed to larger size and high resolution using mass production technology and a result of research and development. The active matrix liquid crystal display panel drives liquid crystal cells by using thin film transistors (hereinafter "TFT").

A liquid crystal display device, displaying a picture through the liquid crystal display panel, controls light transmittance of a liquid crystal material using an electric field to thereby display a picture. To this end, the liquid crystal display device includes a liquid crystal display panel having the liquid crystal cells arranged in an active matrix form, and driving circuits for driving the liquid crystal panel.

FIG. 1 is a perspective view illustrating a related art liquid crystal panel.

Referring to FIG. 1, the related art liquid crystal display panel 1 includes a color filter array substrate 20 and a TFT array substrate 30 that are combined each other with a liquid crystal layer 10 positioned therebetween. The liquid crystal display panel 1 shown in FIG. 1 represents a portion of a full effective display.

In the color filter array substrate 20, a color filter 24 and a common electrode 26 are formed on a rear surface of an upper glass substrate 22. A polarizer 28 is attached on an entire surface of the upper glass substrate 22. The color filter 24 includes the color filter layers of red R, green G and blue B colors that transmit light of particular wavelength bandwidth to display colors corresponding thereto, respectively. A black matrix (not shown) is formed between the color filters 24 adjacent with each other. The black matrix is formed between the color filters 24 of red R, green G and blue B to separate the color filters 24 of red R, green G and blue B from each other and to absorb the light incident from adjacent cells, to thereby prevent deterioration in the contrast of the device.

In the TFT array substrate 30, data lines 34 and gate lines 40 cross on an entire surface of a lower glass substrate 32. TFTs 38 are formed at the crossings of the data lines 34 and the gate lines 40, respectively. A pixel electrode 36 is formed at a cell region between each of the data lines 34 and each of the gate lines 40 in the entire surface of the lower glass substrate 32.

Each TFT 38 includes a gate electrode connected to a gate line 40, a source electrode connected to a data line 34 and a drain electrode facing the source electrode with a channel positioned therebetween. The TFT 38 is connected to the pixel electrode 36 via a contact hole passing through the drain electrode. The TFT 38 selectively provides a data signal from the data line 34 to the pixel electrode 36 in response to a gate signal from the gate line 40. The TFT 38 switches a data transferring path between the data line 34 and the pixel electrode 36 in response to the gate signal from the gate line 40, to thereby drive the pixel electrode 36. A polarizer 42 is disposed on a rear surface of the TFT array substrate 30.

The pixel electrode 36 is positioned in a cell region partitioned by the data line 34 and the gate line 40 and is made of a transparent conductive material having a high light transmittance. The pixel electrode 36 generates a potential difference along with a common electrode 26, which is formed on the upper glass substrate 22, by a data signal inputted via the drain electrode. The liquid crystal layer 10 adjusts an amount of light transmitted therethrough via the TFT array substrate 30 in response to an electric filed applied thereto. The liquid crystal material of the liquid crystal layer 10 positioned between the lower glass substrate 32 and the upper glass substrate 22 rotates due to a dielectric anisotropy by the potential difference between the pixel electrode 36 and the common electrode 26. Accordingly, the light from a light source is transmitted toward the upper glass substrate 22.

Polarizers 28 and 42 disposed on the color filter array substrate 20 and the TFT array substrate 30 transmit the light polarized in any direction. When the liquid crystal material of the liquid crystal layer 10 is 90° twisted nematic (TN) mode material, the polarization directions of the polarizers 28 and 42 are perpendicular to each other. An alignment film (not shown) is formed on the facing surfaces of the color filter array substrate 20 and the TFT array substrate 30.

In order to form a pattern on the color filter array substrate 20 or the TFT array substrate 30, a photo-resist is applied to the upper glass substrate 22 or the lower glass substrate 32 including a thin film having a conductive layer, an insulating layer or a semiconductor layer. Thereafter, an exposure process selectively irradiating the photo-resist with ultraviolet rays using a photo mask and a development process developing the exposed photo-resist are performed to form a photo-resist pattern. The photo mask includes a mask substrate made of a transparent substance whose exposed area becomes an exposure area, and a shielding layer formed on the mask substrate to make a shielding region. The thin film is patterned through an etching process using the photo-resist pattern as a mask, to thereby provide the pattern.

FIG. 2 is a perspective view illustrating an apparatus for coating a photo-resist layer on the substrate, and FIG. 3 is a sectional view illustrating the operation of the coating apparatus shown in FIG. 2.

The coating apparatus shown in FIGS. 2 and 3 includes a stage 50 on which an upper or a lower glass substrate 22 or 32 is mounted, and a slit nozzle 52 for applying a photo-resist liquid 54 on the upper or the lower glass substrate 22 or 32.

The slit nozzle 52 is separated from the upper or the lower glass substrate 22 or 32 by a distance of 30 μm to 200 μm and is moved along a longitudinal direction of the upper or the lower glass substrate 22 or 32, so that it applies the photo-resist liquid 54 on the upper or the lower glass substrate 22 or 32 to form a photo-resist layer 56.

Even though the slit nozzle 52 is separated from the upper or the lower glass substrate 22 or 32 by the distance of 30 μm to 200 μm to apply the photo-resist liquid 54 to the upper or the lower glass substrate 22 or 32, bubbles occur upon forming the photo-resist layer 56 on the upper or the lower substrate 22 or 32, as shown in FIG. 3. In this case, a poor photo-resist layer is formed when the photo-resist layer 56 is further processed, such as when it is baked at a temperature of 100° C.

Further, if the photo-resist layer 56 is coated on an upper or lower glass substrate 22 or 32 that has impurities, then the slit nozzle 52 applying the photo-resist liquid on the upper or the lower glass substrate 22 or 32 may be damaged. In addition, the upper or the lower glass substrate 22 or 32 may also be damaged.

BRIEF SUMMARY

An apparatus in one embodiment includes a stage. A slit nozzle has a diameter large enough to permit a liquid used in fabrication of a liquid crystal display panel (such as photo-resist) to pass therethrough and be applied towards the stage. A nozzle driver drives the slit nozzle in a scan direction. A gas supplier supplies a gas (such as nitrogen) through the slit nozzle toward the stage. Gaseous matter, such as air, between the stage and the slit nozzle is inhaled through the slit nozzle to a gaseous matter intake.

In another embodiment, a method of fabricating a liquid crystal display panel includes removing gaseous matter and/or impurities on a substrate, applying a photo-resist or other liquid on the substrate, and spraying a gas on the liquid applied to the substrate.

BRIEF DESCRIPTION OF THE DRAWINGS

Embodiments of the present invention include the accompanying drawings, in which.

DETAILED DESCRIPTION

Reference will now be made in detail to the preferred embodiments of the present invention, examples of which are illustrated in the accompanying drawings.

Hereinafter, the preferred embodiments of the present invention will be described in detail with reference to FIGS. 4 to 7.

Figure 1:
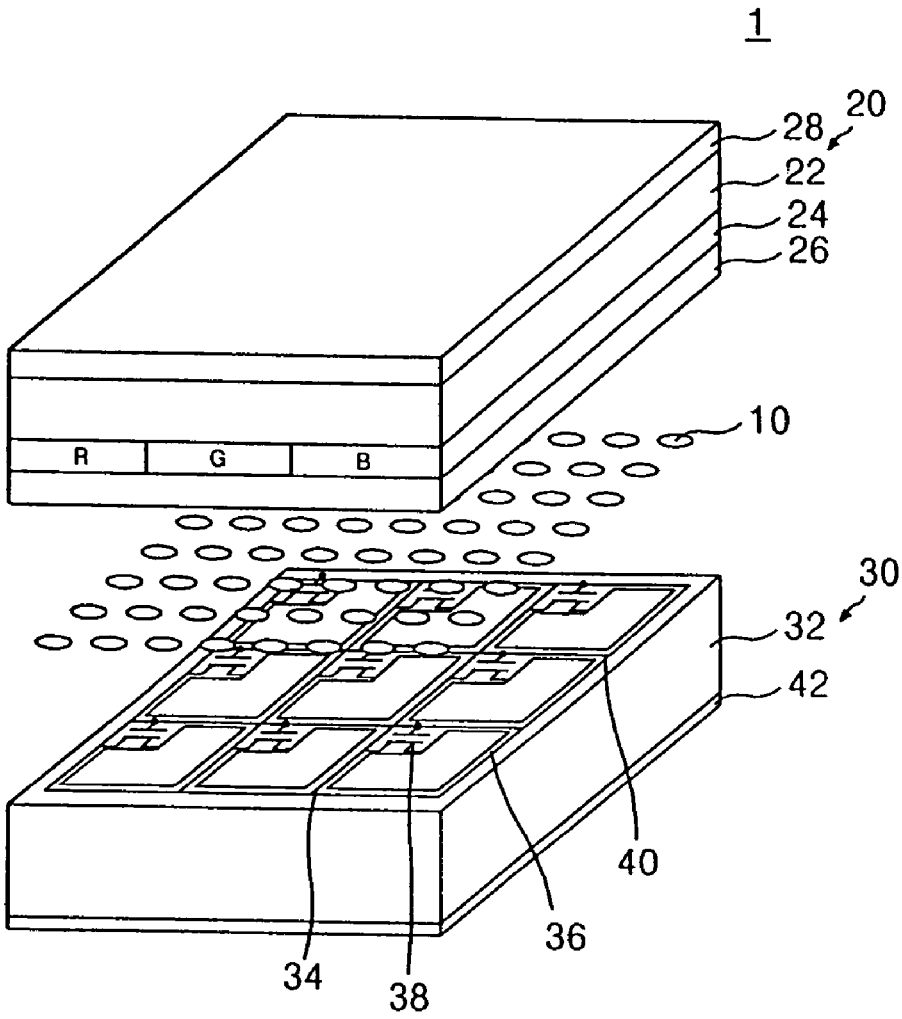
FIG. 1 RELATED ART
FIG. 1 is a perspective view illustrating a related art liquid crystal display panel.
Figure 2:
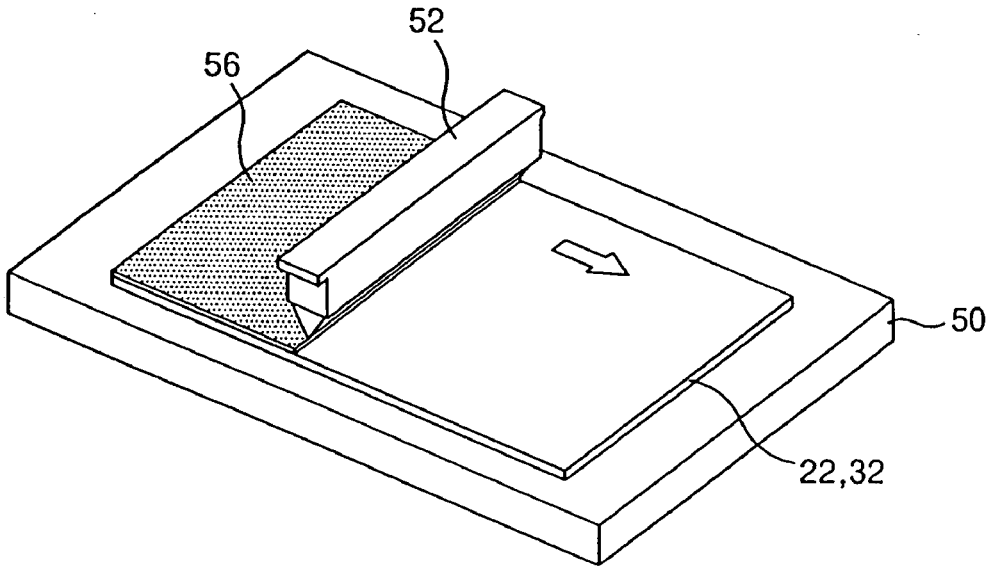
FIG.2 RELATED ART
FIG. 2 is a perspective view illustrating a known apparatus for coating a photo-resist layer on a substrate.
Figure 3:
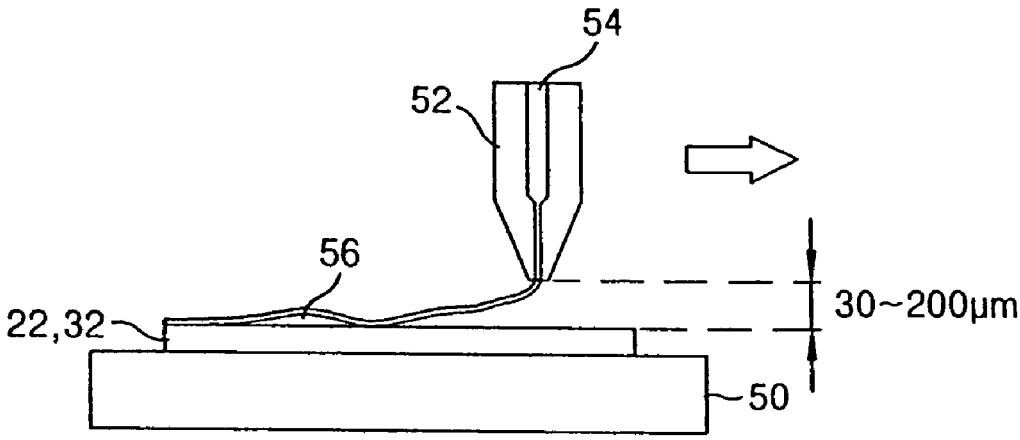
FIG.3 RELATED ART
FIG. 3 is a sectional view illustrating the operation the apparatus for coating the photo-resist layer shown in FIG. 2.
Figure 4:
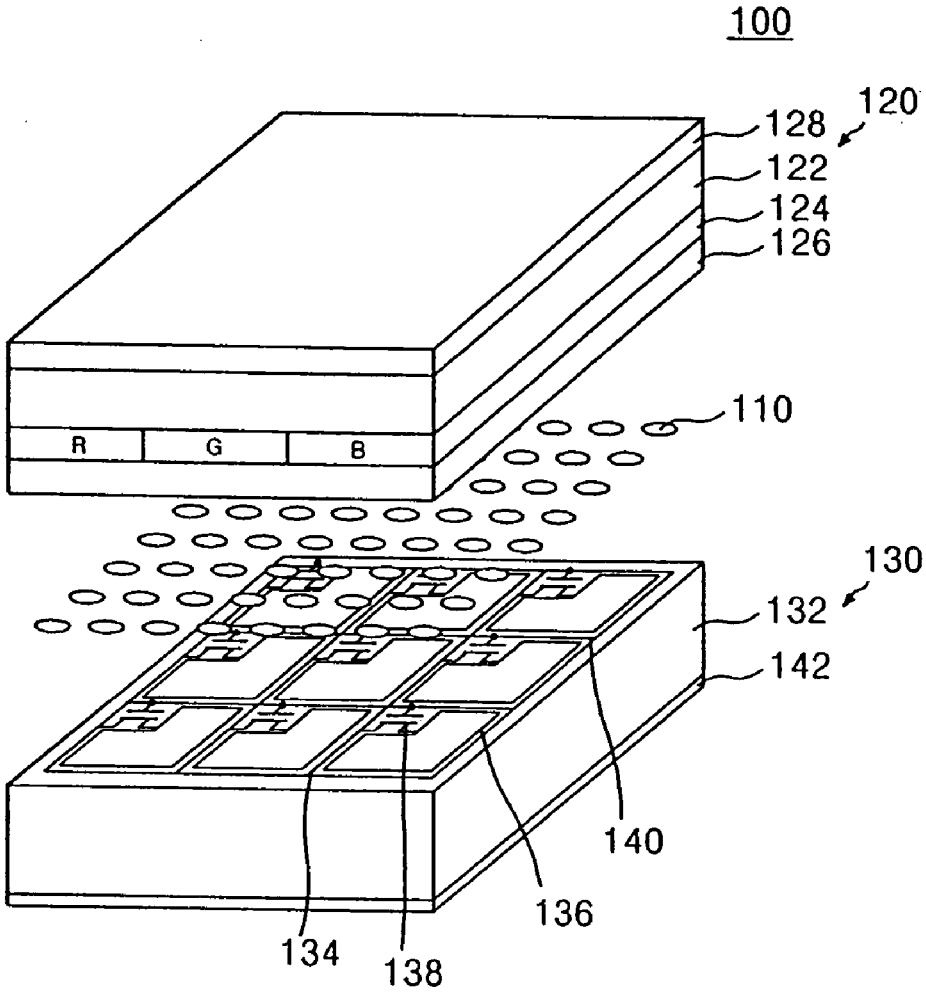
FIG. 4 is a perspective view illustrating a liquid crystal display panel fabricated by using a fabricating apparatus according to one embodiment of the present invention.

FIG. 4 is a perspective view illustrating a liquid crystal display panel fabricated by using a coating apparatus of a photo-resist layer according to one embodiment of the present invention.

Figure 5:
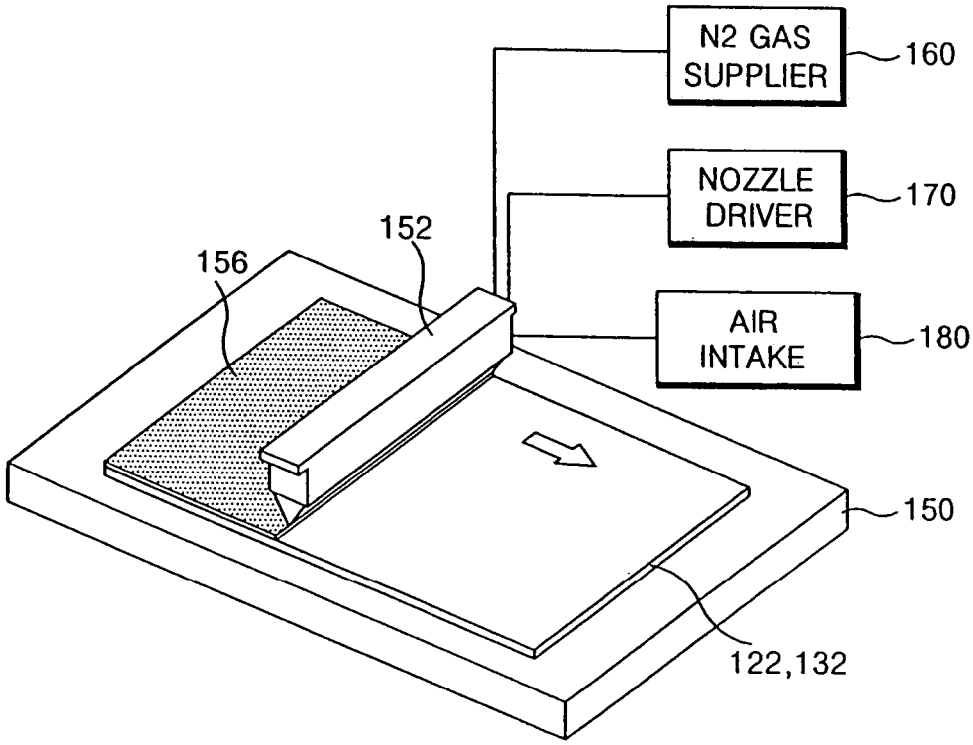
FIG. 5 is a perspective view illustrating the fabricating apparatus of the liquid crystal display panel according to one embodiment of the present invention.

Referring to FIG. 4, a liquid crystal display panel 100 includes a color filter array substrate 120 and a TFT array substrate 130 that are combined each other with a liquid crystal layer 110 positioned therebetween. The liquid crystal display panel 100 shown in FIG. 5 represents a portion of a full effective display.

In the color filter array substrate 120, a color filter 124 and a common electrode 126 are formed on a rear surface of an upper glass substrate 122. A polarizer 128 is attached to an entire surface of the upper glass substrate 122. The color filter 124 includes color filter layers of red R, green G and blue B colors that transmit light of particular wavelength bandwidth to display colors corresponding thereto, respectively. A black matrix (not shown) is formed between the color filters 124 adjacent each other. The black matrix is formed between the color filters 124 of red R, green G and blue B to separate the color filters 124 of red R, green G and blue B each other and to absorb the light incident from adjacent cells, to thereby prevent deterioration in the contrast of the device.

In the TFT array substrate 130, data lines 134 and gate lines 140 cross on an entire surface of the lower glass substrate 132. TFTs 138 are formed at the crossings of the data lines 134 and the gate lines 140, respectively. A pixel electrode 136 is formed at a cell region between each of the data lines 134 and each of the gate lines 140 in the entire surface of the lower glass substrate 132.

Each TFT 138 includes a gate electrode (not shown) connected to the gate line 140, a source electrode (not shown) connected to the data line 134 and a drain electrode (not shown) facing the source electrode with a channel positioned therebetween. The TFT 138 is connected to the pixel electrode 136 via a contact hole passing through the drain electrode. The TFT 138 selectively provides a data signal from the data line 134 to the pixel electrode 136 in response to a gate signal from the gate line 140. The TFT 138 switches a data transferring path between the data line 134 and the pixel electrode 135 in response to the gate signal from the gate line 140, to thereby drive the pixel electrode 136. A polarizer 142 is disposed on a rear surface of the TFT array substrate 130.

The pixel electrode 136 is positioned in a cell region partitioned by the data line 134 and the gate line 140 and is made of a transparent conductive material having a high light transmittance. The pixel electrode 136 generates a potential difference along with a common electrode 126, which formed on the upper glass substrate 122, by a data signal inputted via the drain electrode. The liquid crystal layer 110 adjusts an amount of light transmitted therethrough via the TFT array substrate 130 in response to an electric filed applied thereto. A liquid crystal material of the liquid crystal layer 110 positioned between the lower glass substrate 132 and the upper glass substrate 122 rotates due to a dielectric anisotropy by the potential difference of the pixel electrode 136 and the common electrode 126. Accordingly, the light from a light source (not shown) is transmitted toward the upper glass substrate 122.

Polarizers 128 and 142 disposed on the color filter array substrate 120 and the TFT array substrate 130 transmit the light polarized in a particular direction. When the liquid crystal material of the liquid crystal layer 10 is 90° TN mode, the polarization directions of the polarizers 128 and 142 are perpendicular to each other. An alignment film (not shown) is formed on the facing surfaces of the color filter array substrate 20 and the TFT array substrate 130.

In order to form a pattern on the color filter array substrate 120 or the TFT array substrate 130, a photo-resist is applied on the upper glass substrate 122 or the lower glass substrate 132 including a thin film having a conductive layer, an insulating layer and/or a semiconductor layer. Thereafter, an exposure process selectively irradiating the photo-resist with ultraviolet rays using a photo mask and a development process developing the exposed photo-resist are performed to form a photo-resist pattern. The photo mask includes a mask substrate made of a transparent substance whose exposed area becomes an exposure area, and a shielding layer formed on the mask substrate to make a shielding region. The thin film is patterned through an etching process using the photo-resist pattern as a mask, to thereby provide the pattern.

Figure 6:
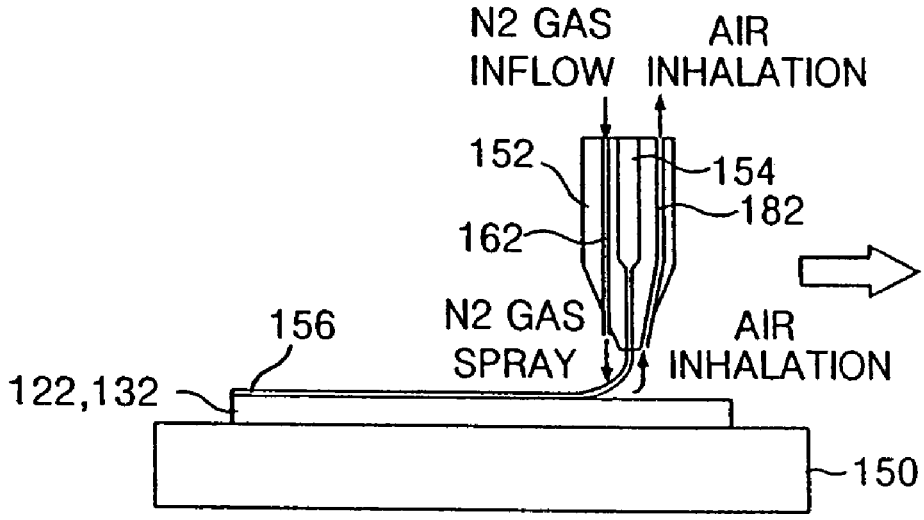
FIG. 6 is a sectional view illustrating a fabricating apparatus of a liquid crystal display panel according to a first embodiment of the present invention.

FIG. 5 is a perspective view illustrating the fabricating apparatus of the liquid crystal display panel according to an embodiment of the present invention, and FIG. 6 is a sectional view illustrating a fabricating apparatus of a liquid crystal display panel according to a first embodiment of the present invention.

The fabricating apparatus of the liquid crystal display panel shown in FIGS. 5 and 6 is used for coating a photo-resist layer 156 on an upper or a lower glass substrate 122 or 132. The fabricating apparatus includes: a stage 150 on which the upper or the lower glass substrate 122 or 132 is mounted; a slit nozzle 152 applying a photo-resist liquid 154 on the upper or the lower glass substrate 122 or 132; a nozzle driver 170 driving the slit nozzle 152; a nitrogen gas supplier 160 supplying nitrogen (N2) gas to the slit nozzle 152; and an air intake 180 inhaling air and/or impurities present on the upper or the lower glass substrate 122 or 132 through the slit nozzle 152.

The slit nozzle 152 has a space in which a photo-resist liquid 154 is filled. The photo-resist liquid 154 is supplied to the space through an inlet formed at an upper side of the slit nozzle 152. The photo-resist liquid 154 is sprayed on the upper or the lower glass substrate 122 or 132 through a jet having a width narrower than that of the inlet.

In the nozzle 152, an injection pipe 162 for spraying the N2 gas on the upper or lower glass substrate 122 or 132 is formed at a rear part with respect to a scan direction of the slit nozzle 152, and an intake pipe 182 for inhaling the air and the impurities on the upper or the lower glass substrate 122 or 132 is formed at a front part with respect to the scan direction of the slit nozzle 152. The injection pipe 162 has an inlet through which the N2 gas enters and an outlet through which the N2 gas exits towards the upper or lower glass substrate 122 or 132. The slit nozzle 152 is driven by the nozzle driver 170.

The nozzle driver 170 is engaged with the slit nozzle 152 to make the slit nozzle 152 move along a longitudinal direction of the upper or the lower glass substrate 122 or 132.

The nitrogen gas supplier 160 supplies high pressure N2 gas through the injection pipe 162 formed in the slit nozzle 152 to spray the high pressure N2 gas on the upper or the lower glass substrate 122 or 132.

The air intake 180 inhales air through the intake pipe 182 formed in the slit nozzle 152, to thereby inhale the air and the impurities on the upper or the lower glass substrate 122 or 132.

The slit nozzle 152 is separated from the upper or the lower glass substrate 122 or 132 by a distance of 30 μm to 200 μm and moves along a longitudinal direction of the upper or the lower glass substrate 122 or 132, so that the slit nozzle 152 applies the photo-resist liquid 154 on the upper or the lower glass substrate 122 or 132 to form a photo-resist layer 156.

When the photo-resist liquid 154 is applied to the upper or the lower glass substrate 122 or 132 while the slit nozzle 152 is moved, the air intake 180 inhales air in front of the region to be applied by the photo-resist liquid 154, through the intake pipe 182, to thereby inhale the air and the impurities on the upper or the lower glass substrate 122 or 132. At the same time, the nitrogen gas supplier 160 supplies the high pressure N2 gas to the injection pipe 162 to spray it onto the photo-resist liquid 154 applied on the upper or the lower glass substrate 122 or 132 in a direction perpendicular to the upper or the lower glass substrate 122 or 132. That is, the high pressure N2 gas sprayed from the injection pipe 162 pressurizes the photo-resist liquid 154 applied on the upper or the lower glass substrate 122 or 132. Accordingly, it is possible to prevent bubbles from being generated on the photo-resist layer 156.

According to the fabricating apparatus of the liquid crystal display panel of the first embodiment of the present invention, the air in front of the region to be applied by the photo-resist liquid 154 on the upper or the lower glass substrate 122 or 132 is inhaled when the photo-resist layer 156 is coated on the upper or the lower glass substrate 122 or 132, and the photo-resist liquid 154 applied on the upper or the lower glass substrate 122 or 132 is pressurized by the N2 gas. Accordingly, it is possible to prevent the generation of bubbles in the photo-resist layer 156.

According to the fabricating apparatus of the liquid crystal display panel of the first embodiment of the present invention, the impurities in front of the region to be applied by the photo-resist liquid 154 on the upper or the lower glass substrate 122 or 132 are removed, to thereby prevent damage to the fabricating apparatus caused by the impurities. Further, it is possible to prevent problems with the liquid crystal display panel being caused by the impurities.

Figure 7:
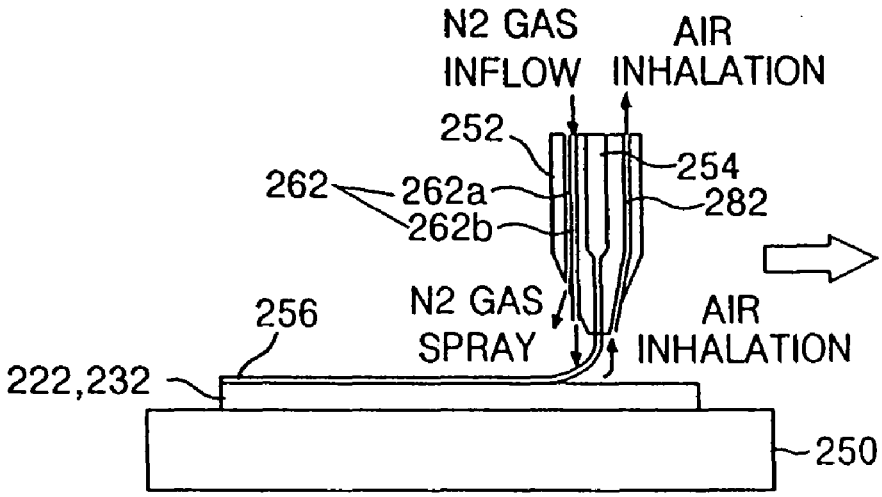
FIG. 7 is a sectional view illustrating a fabricating apparatus of a liquid crystal display panel according to a second embodiment of the present invention.

FIG. 7 is a sectional view illustrating a fabricating apparatus of a liquid crystal display panel according to a second embodiment of the present invention.

The fabricating apparatus of a liquid crystal display panel according to the second embodiment of the present invention is similar that of the fabricating apparatus of the liquid crystal display panel according to the first embodiment of the present invention except for the slit nozzle. Therefore, a detailed explanation therefor will be omitted for the sake of simplicity.

The fabricating apparatus of the liquid crystal display panel shown in FIG. 7 coats a photo-resist layer 256 on an upper or a lower glass substrate 222 or 232. The fabricating apparatus includes: a stage 250 on which the upper or the lower glass substrate 222 or 232 is mounted; a slit nozzle 252 applying a photo-resist liquid on the upper or the lower glass substrate 222 or 232; a nozzle driver (not shown) driving the slit nozzle 252; a nitrogen (N2) gas supplier (not shown); and an air intake (not shown).

The slit nozzle 252 has a space where a photo-resist liquid 254 is filled therein. The photo-resist liquid 254 is supplied to the space through an inlet formed at an upper side of the slit nozzle 252. The photo-resist liquid 254 is sprayed on the upper or the lower glass substrate 222 or 232, through a jet having a width narrower than that of the inlet.

In the nozzle 252, a first injection pipe **262*a* and a second injection pipe 262*b* for spraying the N2 gas on the upper or lower glass substrate 222 or 232 are formed at a rear part with respect to a scan direction of the slit nozzle 252, and an intake pipe 282 for inhaling the air and the impurities on the upper or the lower glass substrate 222 or 232 is formed at a front part with respect to the scan direction of the slit nozzle 252. The injection pipe 262 has an inlet to which the N2 gas is provided, and an outlet from which the N2 gas flows towards the photo-resist layer 256. The slit nozzle 252** is driven by a nozzle driver as similar to that of the first embodiment.

The slit nozzle 252 is separated from the upper or the lower glass substrate 222 or 232 by a distance of 30 μm to 200 μm and is moved along a longitudinal direction of the upper or the lower glass substrate 222 or 232, so that the slit nozzle 252 applies the photo-resist liquid 254 to the upper or the lower glass substrate 222 or 232 to form the photo-resist layer 256.

When the photo-resist liquid 254 is applied to the upper or the lower glass substrate 222 or 232 while the slit nozzle 252 is moved, the air intake inhales the air in front of the region to be applied with the photo-resist liquid 254, through the intake pipe 282, to thereby inhale the air and the impurities on the upper or the lower glass substrate 222 or 232. At the same time, the N2 gas supplier supplies high pressure N2 gas to the first injection pipe 262*a* and the second injection pipe 262*b* to spray it onto the photo-resist liquid 254 applied on the upper or the lower glass substrate 222 or 232 in a perpendicular direction and in an oblique direction with respect to the upper or the lower glass substrate 222 or 232. That is the high pressure N2 gas sprayed from the first injection pipe 262*a* and the second injection pipe 262*b* pressurizes a large area of the photo-resist liquid 254 applied on the upper or the lower glass substrate 222 or 232. Accordingly, it is possible to prevent bubbles from being generated in the photo-resist layer 256.

According to the fabricating apparatus of the liquid crystal display panel of the second embodiment of the present invention, the air in front of the region to be applied by the photo-resist liquid 254 on the upper and the lower glass substrates 222 and 232 is inhaled when the photo-resist layer 256 is coated on the upper or the lower glass substrate 222 or 232, and the photo-resist liquid 254 applied on the upper or the lower glass substrate 222 or 232 by the N2 gas. Accordingly, it is possible to prevent the generation of bubbles on the photo-resist layer 256.

According to the fabricating apparatus of liquid crystal display panel of the second embodiment of the present invention, the impurities in front of the region to be applied by the photo-resist liquid 254 on the upper or the lower glass substrate 222 or 232 are removed, to thereby prevent damage of the fabricating apparatus caused by the impurities. Further, it is possible to prevent problems with the liquid crystal display panel caused by the impurities.

As described above, the air in front of region to be applied by the photo-resist liquid on the upper or the lower glass substrate is inhaled when the photo-resist layer is coated on the upper or the lower glass substrate, and the photo-resist liquid applied on the upper or the lower glass substrate by the N2 gas. Accordingly, it is possible to prevent the generation of bubbles in the photo-resist layer.

Further, according to the present invention of the apparatus and the method of fabricating the liquid crystal display panel, the impurities in front of the region to be applied by the photo-resist liquid on the upper or the lower glass substrate are removed, to thereby prevent damage of the fabricating apparatus caused by the impurities. Also, it is possible to prevent problems with the liquid crystal display panel caused by the impurities.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of fabricating a liquid crystal display panel containing a substrate, the method comprising:

inhaling gaseous matter on a surface of the substrate using an intake pipe of a slit nozzle, wherein the slit nozzle includes a first injection pipe for injecting a photo resist liquid, a second injection pipe for spraying a gas and the intake pipe for intaking the gaseous matter, is spaced from the substrate, wherein the intake pipe, the first injection pipe and the second injection pipe are sequentially arranged along a moving direction of the slit nozzle;

applying the photo resist liquid to the surface of the substrate through the first injection pipe of the slit nozzle while the slit nozzle is moving along a longitudinal direction of the substrate; and spraying the gas on the photo resist liquid applied to surface of the substrate through the second injection pipe of the slit nozzle perpendicular to the surface of the substrate, wherein the gas from the second injection pipe of the slit nozzle is sprayed on only the photo resist liquid applied on the surface of the substrate in a direction perpendicular to the surface of the substrate to prevent bubbles from being generated on the photo resist liquid applied to surface of the substrate, and wherein the slit nozzle further comprises a third injection nozzle disposed adjacent to the second injection nozzle and spraying a gas onto the photo resist liquid applied to the surface of the substrate in an oblique direction with respect to the substrate.

2. The method according to claim 1, further comprising removing the gaseous matter and supplying the gas from different channels in one nozzle.

3. The method according to claim 1, further comprising mitigating formation of bubbles between the liquid and the surface of the substrate by removing the gaseous matter from an area of the surface shortly before the liquid is applied to the area.

4. The method according to claim 1, wherein the gas comprises an inert gas.

5. The method according to claim 4, wherein the inert gas is nitrogen.

6. The method according to claim 1, further comprising removing a substantial amount of impurities on the surface of the substrate at the same time as inhaling the gaseous matter.

* * * * *